US009803869B2

(12) United States Patent
Clemen et al.

(10) Patent No.: US 9,803,869 B2
(45) Date of Patent: Oct. 31, 2017

(54) GAS TURBINE COMBUSTION CHAMBER AND METHOD FOR MANUFACTURING THE SAME

(71) Applicant: Rolls-Royce Deutschland Ltd & Co KG, Blankenfelde-Mahlow (DE)

(72) Inventors: Carsten Clemen, Mittenwalde (DE); Miklós Gerendás, Am Mellensee (DE); Michael Ebel, Rangsdorf (DE); Stefan Penz, Werneuchen (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 220 days.

(21) Appl. No.: 14/641,833

(22) Filed: Mar. 9, 2015

(65) Prior Publication Data

US 2015/0260409 A1 Sep. 17, 2015

(30) Foreign Application Priority Data

Mar. 11, 2014 (DE) ..... 10 2014 204 468

(51) Int. Cl.
*F02C 1/00* (2006.01)
*F23R 3/60* (2006.01)
*F23R 3/28* (2006.01)

(52) U.S. Cl.
CPC ..... *F23R 3/60* (2013.01); *F23R 3/283* (2013.01); *F23R 2900/00018* (2013.01)

(58) Field of Classification Search
CPC ..... F23R 2900/00018; F23R 2900/00017
See application file for complete search history.

(56) References Cited

U.S. PATENT DOCUMENTS

| | | | | |
|---|---|---|---|---|
| 2,988,886 | A | 6/1961 | Lockwood et al. | |
| 6,679,063 | B2 | 1/2004 | Ebel | |
| 7,082,771 | B2 | 8/2006 | Jeppel et al. | |
| 8,646,279 | B2 | 2/2014 | Schreiber et al. | |
| 2006/0054079 | A1* | 3/2006 | Withey | C30B 29/02 117/108 |
| 2010/0011775 | A1* | 1/2010 | Garry | C23C 4/02 60/752 |
| 2012/0258409 | A1* | 10/2012 | Mansour | F23R 3/286 431/2 |
| 2013/0031904 | A1 | 2/2013 | Garry | |
| 2013/0047618 | A1 | 2/2013 | Gregory | |

FOREIGN PATENT DOCUMENTS

| | | |
|---|---|---|
| DE | 10048864 | 4/2002 |
| DE | 102011076473 | 11/2012 |
| EP | 0943867 | 9/1999 |
| EP | 1443275 | 8/2004 |
| EP | 2282124 | 2/2011 |
| GB | 2432902 | 6/2007 |

OTHER PUBLICATIONS

German Search Report dated Mar. 28, 2014 from counterpart App No. 10 2014 204 468.5.

* cited by examiner

*Primary Examiner* — Gerald L Sung
(74) *Attorney, Agent, or Firm* — Shuttleworth & Ingersoll, PLC; Timothy Klima

(57) ABSTRACT

The present invention relates to a gas-turbine combustion chamber having a head plate as well as an outer and an inner combustion chamber wall, wherein the combustion chamber is formed by segments or partial segments manufactured in one piece by means of a DLD method and welded to one another.

5 Claims, 7 Drawing Sheets

GAS TURBINE COMBUSTION CHAMBER AND METHOD FOR MANUFACTURING THE SAME

Figure 1:
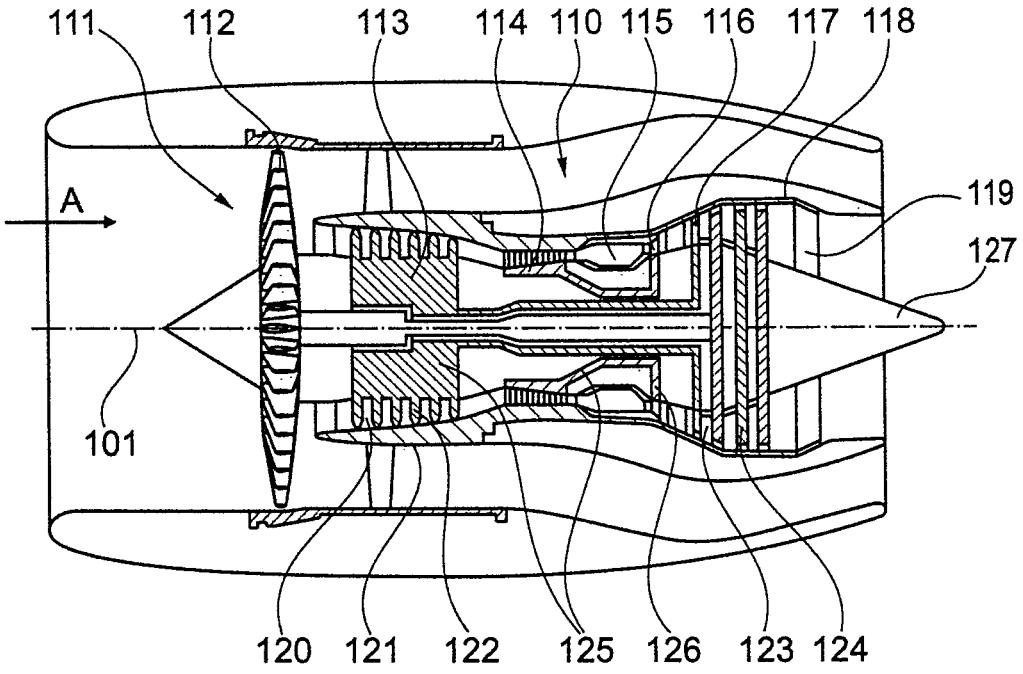

A variety of different embodiments of gas-turbine combustion chambers are known from the state of the art, which are however all designed to the same basic principle, where a combustion chamber outer wall is provided which is produced from a formed sheet metal. Impingement cooling holes are made in this outer combustion chamber wall, usually by means of a boring process. Tiles are fastened to the outer combustion chamber wall and fixed by means of bolts and screws. An inner combustion chamber wall is designed in the same way. For suspension of the combustion chamber, flanges connected to a combustion chamber suspension are used. These parts are for example manufactured as separate forgings and welded to the outer or inner combustion chamber wall, respectively. A combustion chamber head, a head plate and a heat shield are also each manufactured as separate components, mostly as castings. The necessary cooling holes in the heat shield are also made by means of a boring process, like air supply holes in the head plate. The combustion chamber casing is connected to the heat shield and the combustion chamber head as well as to the head plate, partly by means of bolted connections and partly by welding.

The result is that the method of manufacture known from the state of the art requires a very large number of individual parts and involves very high expenditure for its production. In particular, the many components require many different production methods with many production steps. This furthermore results in the disadvantage that inaccuracies and dimensional divergences accumulate during production. The need to provide a plurality of cooling air holes in the combustion chamber wall and the tiles also results in high additional production expenditure. All this leads to very high costs for the manufacture of a gas-turbine combustion chamber too.

The object underlying the present invention is to provide a gas-turbine combustion chamber and a method for its manufacture, which, while being simply designed and easily applicable, reduce the required production effort, increase manufacturing precision of the combustion chamber and lead to a significant cost reduction.

In accordance with the invention, the problem is solved by a gas-turbine combustion chamber having a head plate and an outer and an inner combustion chamber wall, where the latter can be of the single-wall or double-wall design, i.e. with the tile function integrated into the combustion chamber wall and the tile being designed in one piece by means of a OLD method. Accordingly, it is provided, with regard to the method for manufacturing the combustion chamber, that the latter is made in one piece at least with the head plate and with the outer and the inner combustion chamber wall by means of the DLD (direct laser deposition) method.

In a particularly favourable embodiment of the invention, it is provided that the combustion chamber has a U-shaped cross-section and is either manufactured in one piece by means of the DLD method or is assembled from individual segments of U-shaped cross-section which are welded to one another and are each manufactured by means of the DLD method. These segments expediently include at least one combustion chamber sector, but can also extend over several sectors, where the recurrent division on the basis of the fuel nozzles is defined as the combustion chamber sector.

With the DLD method to be used in accordance with the invention, a powdery basic material usually consisting of metallic components is melted on, layer by layer, by means of a laser or an electron beam, so that a three-dimensional workpiece is produced which is of high precision and requires only minor reworking or none at all. Using the DLD method, it is in particular possible to produce highly complex geometries with recesses, cavities and/or undercuts in a way that would not be possible with conventional production, or if so only to a very limited extent.

In a particularly favourable development of the invention, it is provided that at least one combustion chamber flange and/or one combustion chamber suspension are/is manufactured in one piece with the combustion chamber by means of the DLD method. It can be favourable here to manufacture the combustion chamber flange and/or the combustion chamber suspension with an allowance, and to finish-machine it afterwards to suit the installation situation.

With a design of the gas-turbine combustion chamber in accordance with the invention using individual segments of a U-shaped cross-section, it can be advantageous to provide at the joining areas of the segments web-like areas which provide an additional material volume for the subsequent welding operation. It is thus not required during joining of the individual segments to supply additional material, thus leading to a substantial simplification of the welding method.

The joining points can here be in one plane, which is advantageous from the viewpoint of production, but it is also conceivable to match the separation points of the sectors to the traditional design rules for tiles, which make no provision for separation points due to admixing holes. The resultant joining lines represent a line which is more or less curved in the circumferential direction and can be in the opposing direction on the top and bottom sides.

In accordance with the invention, cooling air holes, holes for fastening points, admixing holes, holes for igniter plugs and/or holes for sensors or the like are also manufactured by means of the DLD method. Further additional machining steps can therefore be dispensed with entirely, it is furthermore possible to create the individual holes or recesses with any required cross-sections and any required orientation. This permits design measures that with conventional production methods would not be feasible, or if so only to a limited extent.

In a favourable development of the gas-turbine combustion chamber in accordance with the invention, it is possible either to design a combustion chamber head as a full ring and connect it to the gas-turbine combustion chamber, or to manufacture the combustion chamber head in segmented form. The head plate manufactured by means of the DLD method is preferably provided with positive-fitting positioning means (contact surfaces, spring surfaces and the like) to assure exact positioning of the combustion chamber head.

In accordance with the invention, it is thus furthermore provided that the segments or partial segments include not only either the upper or the lower combustion chamber wall, but also at least a part of the combustion chamber head and/or of the head plate and/or of the heat shield. Widely differing design variants of the combustion chamber in accordance with the invention are therefore possible, which can be adapted to the respective combustion chamber geometry in an optimum way with regard to the additive manufacturing method. A possibility for fitting of the burner seal can be created in suitable manner by providing recesses through which the burner seal can be inserted during the fitting operation.

In an alternative embodiment of the invention, it is possible to divide the segments or partial segments, relative to a combustion chamber center axis, or to provide, as a dividing plane, a plane which is arranged above or below the combustion chamber center axis. In this connection, it must be pointed out that the gas-turbine combustion chamber in accordance with the invention is designed as an annular combustion chamber which is inclined relative to the machine axis. The combustion chamber therefore has a ring shape, with the respective combustion chamber center axis being inclined at an angle to the engine center axis of the gas turbine, The individual combustion chamber center axes of the respective sectional views thus form a cone-shaped envelope relative to the ring shape of the combustion chamber. This means that the individual combustion chamber center axes are arranged on a cone rotationally symmetrical about the machine axis.

The expression "upper and lower parts of the combustion chamber" relates to sectional views selected in the exemplary embodiments, which are aligned in accordance with their installation position and relate to the engine center axis.

Figure 2:
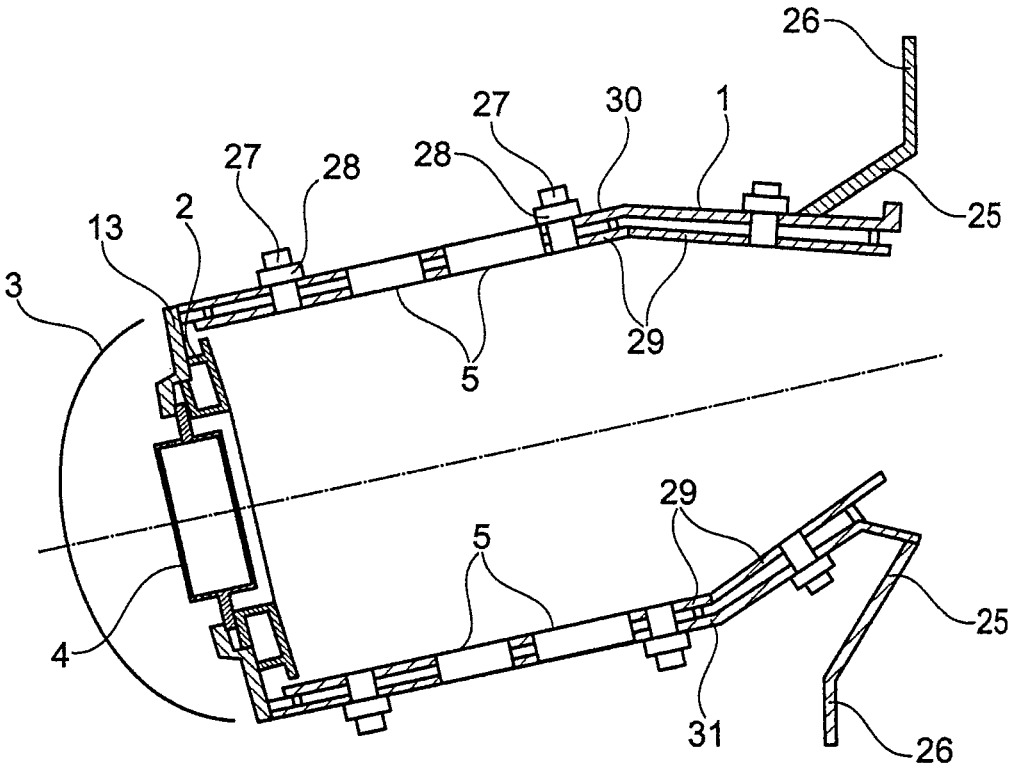
Figure 3:
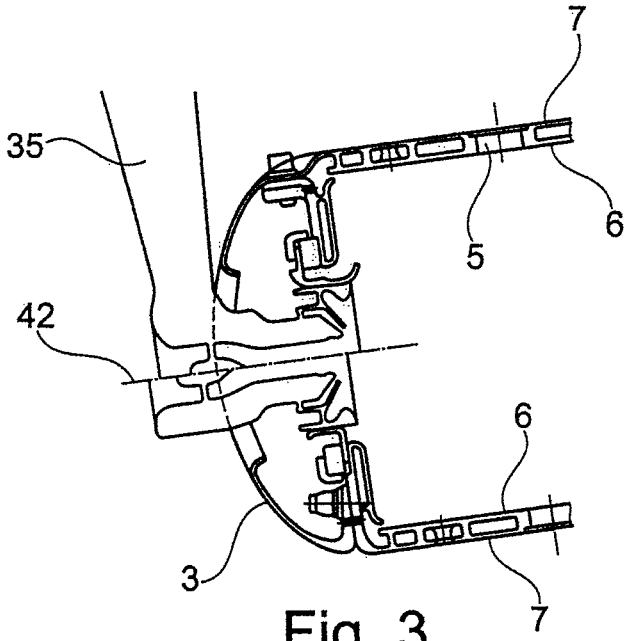
Figure 4:
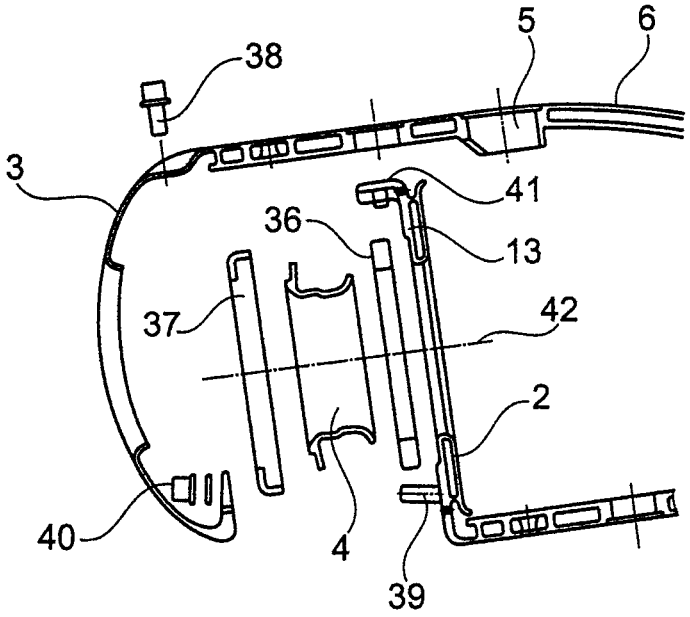
Figure 5:
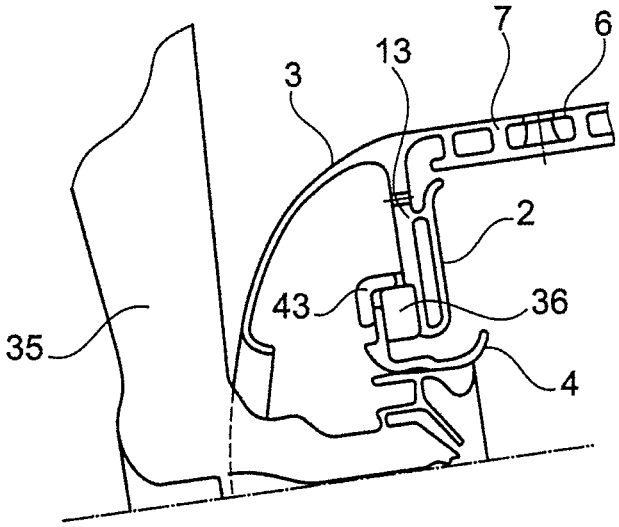
Figure 6:
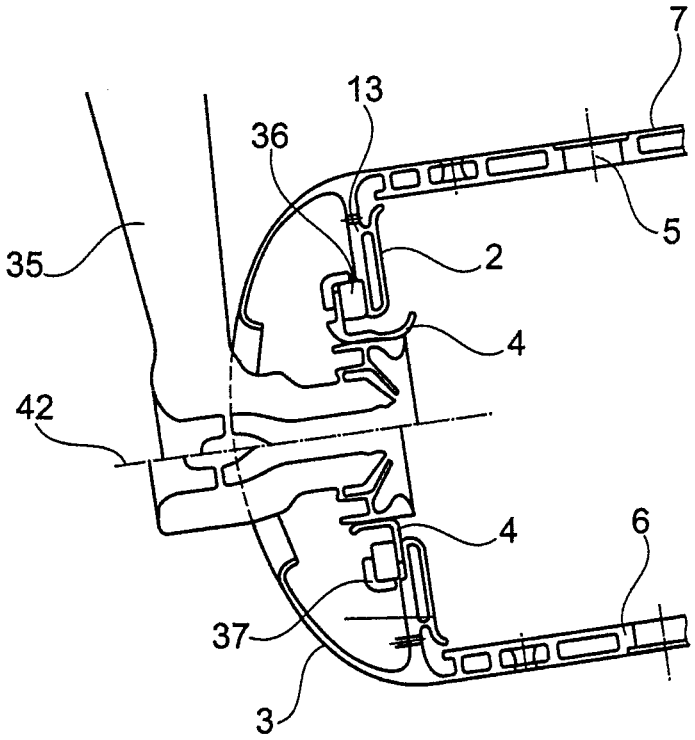
Figure 7:
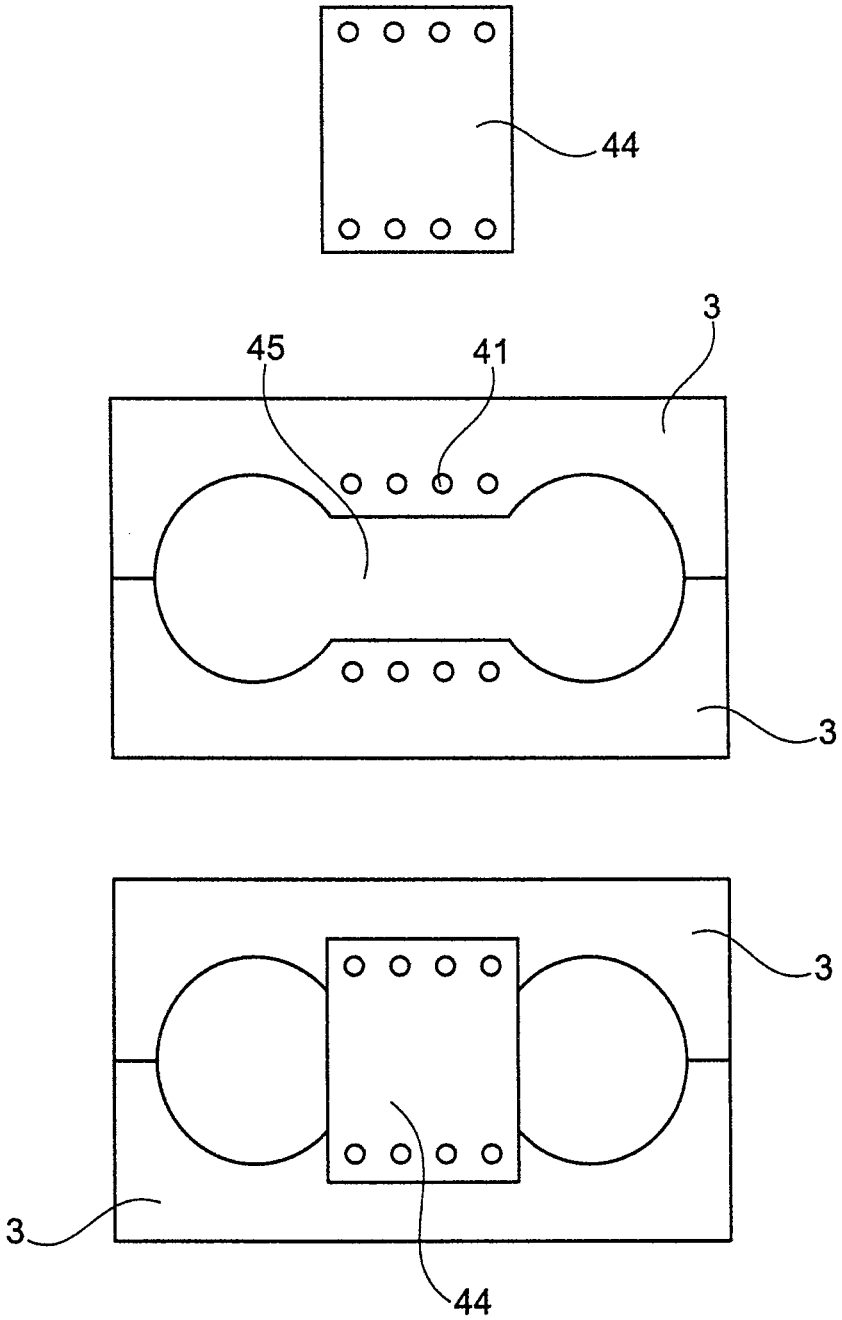
Figure 8:
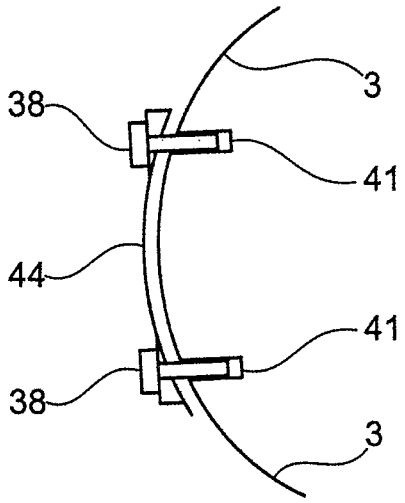
Figure 9:
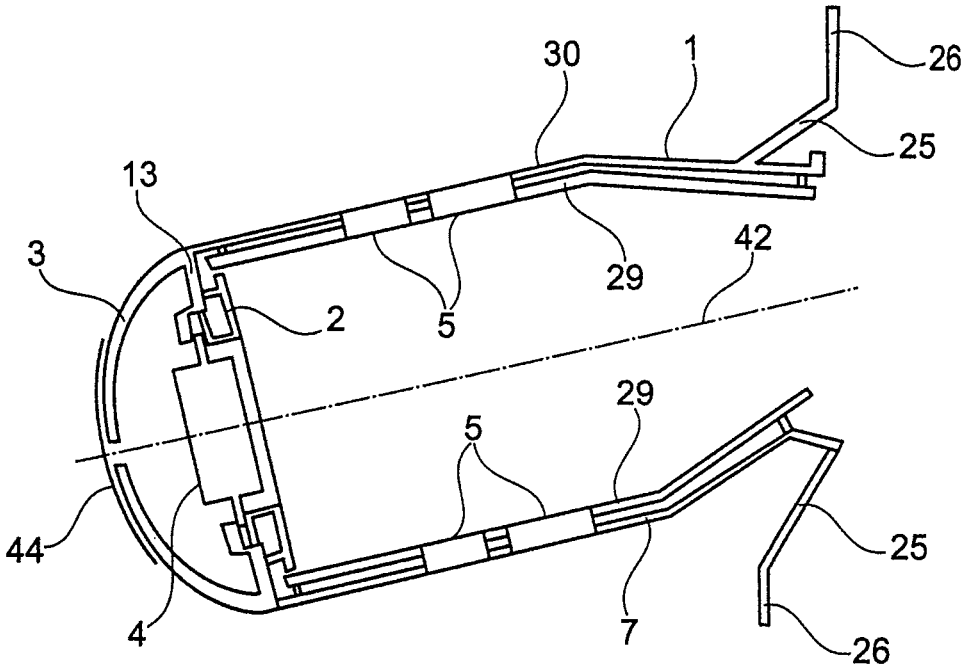
Figure 10:
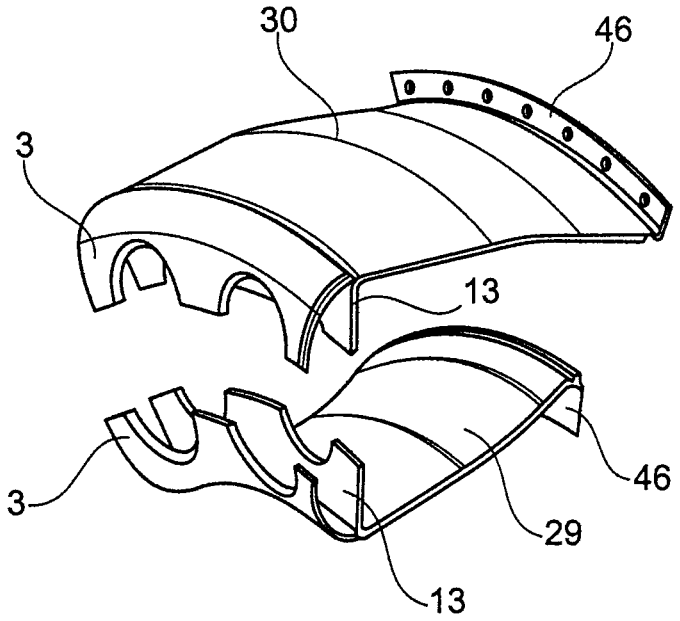

The present invention is described in the following in light of the accompanying drawing, showing exemplary embodiments. In the drawing, FIG. 1 shows a gas-turbine engine for using the gas-turbine combustion chamber in accordance with the present invention, FIG. 2 shows an enlarged, schematized detail sectional view of a combustion chamber in accordance with the state of the art, FIG. 3 shows a simplified partial sectional view of the head-side end area of a combustion chamber, according to the present invention, in accordance with a further exemplary embodiment, FIG. 4 shows a view, by analogy with FIG. 3, in an exploded representation, FIG. 5 shows an enlarged detail view, by analogy with FIGS. 3 and 4, of a modified exemplary embodiment, FIG. 6 shows a view, by analogy with FIG. 5, of a further exemplary embodiment, FIG. 7 shows a simplified representation of a further exemplary embodiment of a combustion chamber head with head plate, FIG. 8 shows a schematic side view of the exemplary embodiment in FIG. 7, FIG. 9 shows a simplified side view of an exemplary embodiment of a combustion chamber in accordance with the present invention with fully integrated segments with head plate, and FIG. 10 shows a perspective view of a further design variant.

The gas-turbine engine 110 in accordance with FIG. 1 is a generally represented example of a turbomachine, where the invention can be used. The engine 110 is of conventional design and includes in the flow direction, one behind the other, an air inlet 111, a fan 112 rotating inside a casing, an intermediate-pressure compressor 113, a high-pressure compressor 114, a combustion chamber 115, a high-pressure turbine 116, an intermediate-pressure turbine 117 and a low-pressure turbine 118 as well as an exhaust nozzle 119, all of which being arranged about an engine center axis 101.

The intermediate-pressure compressor 113 and the high-pressure compressor 114 each include several stages, of which each has an arrangement extending in the circumferential direction of fixed and stationary guide vanes 120, generally referred to as stator vanes and projecting radially inwards from the engine casing 121 in an annular flow duct through the compressors 113, 114. The compressors furthermore have an arrangement of compressor rotor blades 122 which project radially outwards from a rotatable drum or disk 125 linked to hubs 126 of the high-pressure turbine 116 or the intermediate-pressure turbine 117, respectively.

The turbine sections 116, 117, 118 have similar stages, including an arrangement of fixed stator vanes 123 projecting radially inwards from the casing 121 into the annular flow duct through the turbines 116, 117, 118, and a subsequent arrangement of turbine blades 124 projecting outwards from a rotatable hub 126. The compressor drum or compressor disk 125 and the blades 122 arranged thereon, as well as the turbine rotor hub 126 and the turbine rotor blades 124 arranged thereon rotate about the engine center axis 101 during operation.

FIG. 2 shows in enlarged schematic representation a sectional view of a gas-turbine combustion chamber 1 in accordance with the state of the art. The combustion chamber includes a heat shield 2 and a combustion chamber head 3, which, like a burner seal 4, are manufactured as separate components. Furthermore, the combustion chamber 1 is provided with a head plate 13, which is also manufactured as a separate component. An outer combustion chamber wall 30 and an inner combustion chamber wall 31 adjoin the head plate 13. The combustion chamber walls 30 and 31 are made as separate parts from formed sheet metal and provided with bored impingement cooling holes. The combustion chamber 1 is suspended by means of a combustion chamber suspension 25 and combustion chamber flanges 26, which are also manufactured as separate parts, usually as forgings, and welded to the combustion chamber walls 30 and 31.

The combustion chamber head 3, the head plate 13 and the heat shield 2 are, as already mentioned, manufactured as separate components, usually by means of a casting process. In subsequent process steps, it is necessary to provide cooling holes. in particular in the heat shield. Air passage holes in the head plate 13 are also usually bored.

For thermal insulation of the and the inner combustion chamber wall 30, 31, tiles 29 are used which are manufactured individually and provided with effusion holes. The effusion holes are usually bored, while the tiles 29 are manufactured as castings. The tiles 29 are bolted by means of bolts 27 and nuts 28 to the outer and the inner combustion chamber wall 30, 31 or fastened in another way. The result is thus that a very complex structure using a plurality of individually manufactured structural elements is obtained. A considerable effort involving high costs is required for both manufacture and final assembly of the combustion chamber, In addition, dimensional inaccuracies of the individual components accumulate. requiring special additional measures to achieve precise dimensioning of the combustion chamber.

FIGS. 3 and 4 show a further design variant in accordance with the present invention. The hot combustion chamber wall 6 is here designed in one piece with the cold combustion chamber wall 7, where, as can be seen from FIG. 4 in particular, there is a division of the combustion chamber walls symmetrically to a combustion chamber center line 42. The combustion chamber head 3 is designed non-divided and is manufactured in one piece with the upper double-wall combustion chamber wall, while the heat shield 2 and the head plate 13 are designed in one piece with the lower double-wall combustion chamber wall. FIG. 4 shows that a spacer ring 36, the burner seal 4 and a fastening ring 37 for said burner seal 4 are fitted during assembly. Fastening is achieved using bolts 38 and threaded bolts 39. The bolt 38 is screwed into a thread 41 of the head plate 13, while the threaded bolt 39 is fixed using a nut 40, as is shown by the illustration in FIG. 3. The reference numeral 35 indicates a fuel nozzle.

It is also possible in accordance with the invention to invert the structure shown in FIGS. 3 and 4, so that the lower combustion chamber wall includes the combustion chamber head 3, while the upper combustion chamber includes the head plate 13 and the heat shield 2. In both cases. it is necessary, as can be seen from FIGS. 3 and 4, for the base plate 13 and the burner seal 4 to be fitted together with the spacer ring 36 and the fastening ring 37 before final assembly takes place.

FIG. 5 shows an enlarged view of a further design variant, in which the burner seal 4 is designed L-shaped and fastened by means of a receptacle 43 to the heat shield 2.

FIG. 6 shows in an analogous illustration an alternative receptacle for the burner seal 4 in a double-L shape. There are hence in accordance with the invention a wide range of possible variations and modifications for mounting and fitting the burner seal.

FIG. 10 shows the basic principle underlying FIGS. 5 and 6, whereby the combustion chamber segments or the entire annular combustion chamber are divided along the burner center line 42. As can already be seen from FIGS. 5 and 6, the combustion chamber head 3 is here divided centrally in the same way as the base plate 13. The heat shield 2 too can be designed in halves as an integral component. It can clearly be seen from FIG. 10 in particular that the embodiments in accordance with the invention of the combustion chamber forms are designed to be particularly favourable for an additive manufacturing method, for example a DLD method. Due to this halved design of the combustion chamber head 3 and of the heat shield 2 it is possible to insert the burner seal 4, before joining together the upper and the lower half of the combustion chamber wall, into the lower half in a suitable burner seal receptacle 43 integrated into the head plate and then to fit the upper half of the combustion chamber, as is shown for example in FIG. 5. Alternatively, it is also possible, by analogy with FIG. 4, to install a fastening ring 37 and a spacer ring 36 above an access hole 45 (see FIG. 7) in the combustion chamber head 3. The two halves of the combustion chamber are then fitted together in a suitable manner and joined, for example by welding. Alternatively, it is also possible by means of a separate head plate 44 to bolt the parts together. To do so, a plurality of threaded holes are provided on the combustion chamber head 3 for bolting the head plate 44, as is illustrated in FIG. 7. FIG. 7 shows the head plate 44 as a separate part. The center portion of FIG. 7 shows the two halves of the combustion chamber head 3 in the pre-assembled state while the lower portion of FIG. 7 shows the bolted head plate 44.

Alternatively to the design variants described, it is also possible to have the separation not on the combustion chamber center line 42, but at any other point.

FIG. 8 shows the assembled state, making clear in particular the threaded holes 41 and the bolts 38 by which the head plate 44 is held on the combustion chamber head 3.

FIG. 9 again shows an overall view of an exemplary embodiment of the combustion chamber in accordance with the invention, taking into account the exemplary embodiments in FIGS. 5 to 8.

Overall, the combustion chamber in accordance with the invention is manufactured such that with a segmented design the segments are welded to form a complete ring, for example by means of laser welding. The combustion chamber suspension 25 and the combustion chamber flange 26 (see FIG. 9) can be produced with an oversize, also by an additive method (for example DLD) and then be turned or milled down to the final geometry. The holes in the flanges for the bolted connection to the casings are bored subsequently, but can however also be produced by the additive method.

Using the additive production method, the cooling holes can have any hole and duct shapes and sizes, for example round, elliptical, rhomboidal or duct-like, where the alignment with the wall can be designed perpendicular or at any inclination. It is also possible to achieve helical or other geometries. As a result an effective air supply. in particular for cooling, can be assured. The position and the number of the admixing holes 5 can also be selected as required, for example in several rows, offset relative to one another, with differing sizes or in any other embodiment.

LIST OF REFERENCE NUMERALS

1 Combustion chamber
2 Heat shield
3 Combustion chamber head
4 Burner seal
5 Admixing hole
6 Hot, inner combustion chamber wall
7 Cold, outer combustion chamber wall
13 Head plate
25 Combustion chamber suspension
26 Combustion chamber flange
27 Bolt
28 Nut
29 Tile
30 Outer combustion chamber wall
31 Inner combustion chamber wail
35 Fuel nozzle
36 Spacer ring
37 Fastening ring
38 Bolt
39 Threaded bolt
40 Nut
41 Threaded hole
42 Combustion chamber center line
43 Receptacle
44 Head plate
45 Access hole to burner head
101 Engine center axis
110 Gas-turbine engine/core engine
111 Air inlet
112 Fan
113 Intermediate-pressure compressor (compressor)
114 High-pressure compressor
115 Combustion chamber
116 High-pressure turbine
117 Intermediate-pressure turbine
118 Low-pressure turbine
119 Exhaust nozzle
120 Guide vanes
121 Engine casing
122 Compressor rotor blades
123 Stator vanes
124 Turbine blades
125 Compressor drum or disk
126 Turbine rotor hub
127 Exhaust cone

What is claimed is:

1. A method of manufacturing a gas-turbine combustion chamber comprising:

providing that the gas-turbine combustion chamber includes a combustion chamber head, a heat shield, an outer combustion chamber wall, and an inner combustion chamber wall;

providing partial segments of the gas-turbine combustion chamber, the partial segments each manufactured in one piece by a direct laser deposition method, the direct laser deposition method including using at least one chosen from a laser and an electron beam to melt together, layer by layer, a powdery basic material including a metallic component to produce a three-dimensional workpiece;

wherein the partial segments include first partial segments including a portion of the outer combustion chamber wall and second partial segments including a portion of the inner combustion chamber wall;

wherein one of the first partial segments and the second partial segments include a portion of the combustion chamber head, and no portion of the heat shield, manufactured as one piece with the respective portion of the inner combustion chamber wall or outer combustion chamber wall and the other of the first partial segments and the second partial segments include a portion of the heat shield, and no portion of the combustion chamber head, manufactured as one piece with the respective portion of the inner combustion chamber wall or outer combustion chamber wall;

welding the first partial segments and the second partial segments to one another to form the gas-turbine combustion chamber.

2. The method of manufacturing the gas-turbine combustion chamber in accordance with claim 1, and further comprising providing the gas-turbine combustion chamber with a U-shaped cross-section.

3. The method of manufacturing the gas-turbine combustion chamber in accordance with claim 2, and further comprising providing a recess in the combustion chamber head for fitting a combustion chamber seal.

4. The method of manufacturing the gas-turbine combustion chamber in accordance with claim 1, wherein the first partial segments include the portion of the combustion chamber head, and not the portion of the heat shield, manufactured as one piece with the outer combustion chamber wall and the second partial segments include the portion of the heat shield, and not the portion of the combustion chamber head, manufactured as one piece with the inner combustion chamber wall.

5. The method of manufacturing the gas-turbine combustion chamber in accordance with claim 1, wherein the second partial segments include the portion of the combustion chamber head, and not the portion of the heat shield, manufactured as one piece with the portion of the inner combustion chamber wall and the first partial segments include the portion of the heat shield, and not the portion of the combustion chamber head, manufactured as one piece with the outer combustion chamber wall.

* * * * *